United States Patent [19]

Matsuura et al.

[11] Patent Number: 4,483,611

[45] Date of Patent: Nov. 20, 1984

[54] MAGNETIC CLEANING DEVICE

[75] Inventors: Yozo Matsuura, Tokyo; Kazuhiro Yuasa, Zama, both of Japan

[73] Assignee: Ricoh Company, Ltd., Japan

[21] Appl. No.: 459,347

[22] Filed: Jan. 20, 1983

[30] Foreign Application Priority Data

Jan. 20, 1982 [JP] Japan ..... 57-6990
Apr. 10, 1982 [JP] Japan ..... 57-58980

[51] Int. Cl.[3] ..... G03G 21/00
[52] U.S. Cl. ..... 355/15; 15/256.52; 118/652
[58] Field of Search ..... 355/15; 15/1.5, 256.51, 15/256.52; 118/652

[56] References Cited

U.S. PATENT DOCUMENTS 3,950,089 4/1976 Fraser et al. ..... 355/15 X
4,097,140 6/1978 Suzuki et al. ..... 355/15
4,319,832 3/1982 Sakamoto et al. ..... 355/15

*Primary Examiner*—R. L. Moses
*Attorney, Agent, or Firm*—Guy W. Shoup

[57] ABSTRACT

A magnetic cleaning device for cleaning a surface to be cleaned by removing magnetic particles therefrom includes a rotatable sleeve of a nonmagnetic material on the outer peripheral surface of which is planted a plurality of fibers to form a fur brush, a plurality of magnets disposed inside of and along the inner peripheral surface of the sleeve, a rotatable magnetic roll disposed adjacent to the sleeve for having the magnetic particles transferred from the sleeve to the roll, and a collection unit including a scraper to scrape the transferred particles off the roll.

24 Claims, 11 Drawing Figures

MAGNETIC CLEANING DEVICE

BACKGROUND OF THE INVENTION

1. Field of the Invention

This invention generally relates to a cleaning device for cleaning the imaging surface by removing residual toner particles therefrom to prepare the imaging surface for the next imaging cycle, and, in particular, to a magnetic cleaning device for use in an electrostatographic copying machine and the like, which uses magnetic toner particles for development of an electrostatic latent image.

2. Description of the Prior Art

In a typical electrostatographic copying machine such as an electrophotographic or electrostatic copying machine, a toner image, which is a copy of an original image, is formed on the imaging surface and the thus formed toner image is transferred to a transfer medium such as plain paper, followed by cleaning of the imaging surface by removing the nontransferred toner particles remaining on the imaging surface after image transfer thereby preparing the imaging surface ready for the next cycle of operation. A fur brush cleaning device has been commonly used to carry out such a cleaning operation and the typical prior art fur brush cleaning device is comprised of a sleeve on the outer peripheral surface of which is fixedly provided fur brush. The sleeve is driven to rotate such that the fur brush may brush or scrub the imaging surface thereby removing the residual toner particles therefrom. As a result, the toner particles removed from the imaging surface are held by the fur brush and they are transported along the rotation of the sleeve. A knock-off bar is usually provided in scrubbing contact with the fur brush, so that the toner particles now held by the fur brush are knocked off to become airborne. Then these toner particles drifting in the air are brought into a collection chamber as guided by an air flow created by a suction device.

In such a fur brush cleaning device, when the fur brush is made of a material which is charged due to friction with the toner particles and the imaging surface to the polarity opposite to that of the charges acquired by the toner particles, the toner particles may be easily caused to adhere to the fur brush thereby allowing to obtain a high removing efficiency. In such a case, however, since the toner particles rather strongly adhere to the fur brush, the knocking off operation becomes deteriorated, and, therefore, the overall cleaning efficiency stays relatively low. On the other hand, in the case where the fur brush is formed by a material which is electrically conductive or semiconductive, the fur brush is either difficult to be charged or hardly charged due to friction, so that the toner particles may be easily removed from the fur brush. In this case, however, the toner removing operation from the imaging surface is rather low in efficiency.

Under the circumstances, there has been a need for the advent of a new cleaning device.

SUMMARY OF THE INVENTION

The disadvantages of the prior art are overcome with the present invention and an improved cleaning device is hereby provided.

In accordance with one aspect of the present invention, there is provided a magnetic cleaning device for cleaning magnetic particles remaining on the surface to be cleaned, comprising: first carrier means supported to move along a first predetermined path a part of which is located closer to said surface to be cleaned where said magnetic particles may be transferred from said surface to be cleaned to said first carrier means; attracting means for causing said magnetic particles attracted to said first carrier means; second carrier means supported to move along a second predetermined path a part of which is located closer to said first carrier means where said magnetic particles carried on said first carrier means may be transferred to said second carrier means; and collection means for collecting said magnetic particles carried on said second carrier means.

In accordance with another aspect of the present invention, there is provided a magnetic cleaning device for cleaning magnetic toner particles from the imaging surface which is repetitively presented for use, comprising: a sleeve supported to be driven to rotate in a predetermined direction, said sleeve having fur brush fixedly provided on its outer peripheral surface such as to be partly in brushing contact with said imaging surface, said fur brush being comprised of a material which is charged due to friction with said imaging surface and magnetic toner particles to the polarity opposite to that of said magnetic toner particles; magnetic field producing means disposed inside of said sleeve for producing a magnetic field at least around said sleeve so as to cause said magnetic toner particles attracted toward said sleeve; and removing means for removing said magnetic toner particles from said sleeve.

In accordance with a further aspect of the present invention, there is provided a magnetic cleaning device for cleaning magnetic toner particles from the imaging surface after image transfer, said imaging surface being repetitively used for forming a magnetic toner image and then transferring the thus formed toner image to a transfer medium, said device comprising: a sleeve supported to be driven to rotate in a first predetermined direction, said sleeve having fur brush as fixedly provided on its outer peripheral surface so as to be partly in brushing contact with said imaging surface; a magnetic roll disposed in parallel with and adjacent to said sleeve, said magnetic roll being driven to rotate in a second predetermined direction thereby causing the magnetic toner particles transferred from said sleeve to said roll; scraping means for scraping the magnetic toner particles off said roll to be collected in a collection unit; and a plurality of magnetic pole means disposed inside of said sleeve, one of said magnetic pole means being disposed in the downstream side of and separated away over a predetermined distance from the straight line connecting between the centers of said sleeve and roll with respect to the rotating direction of said sleeve.

Accordingly, it is a primary object of the present invention to provide an improved cleaning device for cleaning magnetic particles from the surface to be cleaned.

Another object of the present invention is to provide a magnetic cleaning device suitable for use in electrostatographic copying machines which use magnetic toner particles for developing electrostatic latent images.

A further object of the present invention is to provide a magnetic cleaning device which is high in collection efficiency.

A still further object of the present invention is to provide a magnetic cleaning device which has an extended service life and can offer the unvariable cleaning performance over a long period of time.

Other objects, advantages and novel features of the present invention will become apparent from the following detailed description of the invention when considered in conjunction with the accompanying drawings.

DESCRIPTION OF THE PREFERRED EMBODIMENTS

Figure 1:
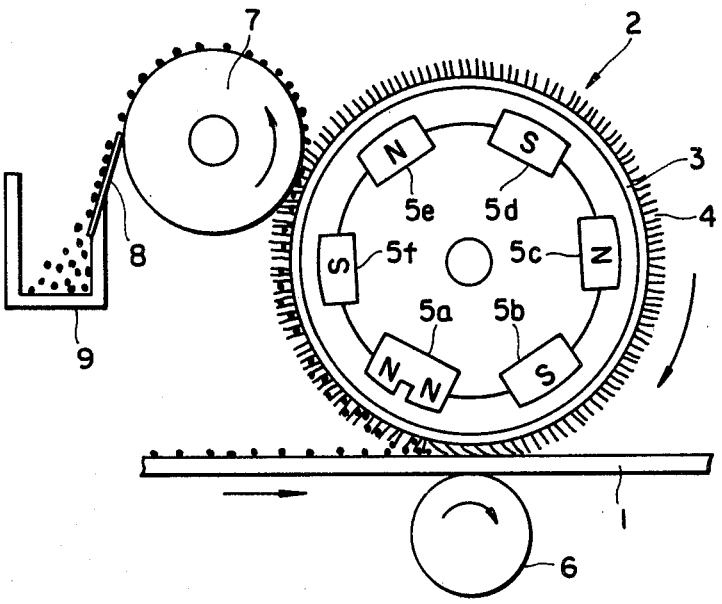
FIG. 1 is a schematic illustration showing the magnetic cleaning device constructed in accordance with one embodiment of the present invention.

Referring now to FIG. 1, there is shown a magnetic cleaning device 2, embodying the present invention, for cleaning the imaging surface of an image carrier member 1. As is well known in the art, the image carrier member 1 may take the form of an endless belt comprised of a photosensitive member or dielectric member and its outside surface defines the imaging surface on which a toner image is to be formed by magnetic toner particles. In FIG. 1, only a part of the image carrier member 1 is shown and it is driven to advance in the direction indicated by the arrow. Although not shown specifically, various devices known to those skilled in the art are disposed along the travelling path of the endless image carrier member 1 for forming a toner image on the imaging surface of the member 1. The thus formed toner image is then transferred to a transfer medium such as plain paper at a transfer station (not shown). After transfer, there still remains nontransferred toner particles on the imaging surface, so that these residual toner particles must be removed before the imaging surface is again presented for use. Accordingly, the image carrier member 1 is then moved into a cleaning station where the magnetic cleaning device 2 is provided with or without the discharging step prior thereto.

The magnetic cleaning device 2 comprises a nonmagnetic sleeve 3 on the peripheral surface of which is fixedlv provided fur brush 4 comprised of nonmagnetic fabrics or fibers. The fur brush 4 may take any desired form as well known to those skilled in the art. For example, the fur brush 4 may be formed by having individual fibers partly planted in the outer peripheral surface of the sleeve 1; alternatively, the fur brush 4 may be formed by having fabrics fixed to the outer peripheral surface of the sleeve 3, for example, by an adhesive. As is well known, it is so structured that the sleeve 3 is rotatably supported and driven to rotate in the direction indicated by the arrow. Inside of the sleeve 3 is disposed a plurality of magnets 5*a*–5*f* arranged in a circle angularly spaced from each other. It is to be noted that these magnets 5*a*–5*f* may be fixedly provided, or, if desired, they may be provided to be rotatable in a desired direction.

As is obvious, the sleeve 3 extends in the axial direction over the width of the image carrier member 1, and the sleeve 3 is so disposed that the fur brush 4 maintains brushing or scrubbing contact with the imaging surface of the image carrier member 1 at its bottom. Preferably, a counter roller 6 is provided to support the image carrier member 1 directly below the sleeve 3 so as to keep a predetermined positional relation between the sleeve 3 and the imaging surface, or a desired brushing contact between the fur brush 4 and the imaging surface, as shown in FIG. 1.

Also provided is a magnetic roll 7 comprised of a magnetic material as disposed adjacent to the sleeve 3. In the illustrated embodiment, the magnetic roll 7 is driven to rotate counter-clockwise as indicated by the arrow, and, thus, in the illustrated example, the magnetic roll 7 rotates in the direction opposite to that of the sleeve 3. Accordingly, the opposed portions of the roll 7 and the sleeve 3 move in the same direction. Furthermore, a blade 8 is provided with its top end in scraping contact with the outer peripheral surface of the roll 7, and the blade 8 is fixedly mounted on a toner collector 9 which collects the toner particles as scraped off the roll 7 and transport the collected toner particles to a desired location.

In accordance with one aspect of the present invention, the fur brush 4 is comprised of a material having the resistivity of $10^8$ ohm·cm or more, and thus the fur brush 4 is relatively insulating in nature. In such a case, if the magnetic toner particles have the property of being charged to the positive polarity due to friction, then selection is made for the material for forming the fur brush 4 such that the fur brush 4 is charged to the negative polarity due to friction with the toner particles and/or the imaging surface, or, at least, the fur brush 4 is difficult to be charged to the positive polarity. For this purpose, the fur brush 4 may be formed by such a material as Teflon ( tradename), polypropylene, polyethylene, vinyl chloride, Tetron (tradename), rayon, polyester, etc. On the other hand, if the magnetic toner particles have the property of being charged to the negative polarity due to friction, the selection should be made for the material for forming the fur brush 4 such that the fur brush 4 is charged to the opposite or positive polarity due to friction with the toner particles and/or the imaging surface or the fur brush 4 is difficult to be charged to the negative polarity. One typical example for such a material is nylon, though similar other materials may be equally applicable.

In accordance with another aspect of the present invention, the fur brush 4 is formed by a material having the resistivity ranging from $10^4$ to $10^8$ ohm·cm, and thus the fur brush 4 is relatively in the semiconductive region. Such a material may be a mixture of an acrylic polymer as a base and fine carbon black particles dispersed in the base. Such a material has a regulated resistivity determined by the ratio in amount between electrically insulating acrylic polymer and electrically conductive carbon black. That is, a desired resistivity may be obtained by appropriately controlling the particle size and mixture ratio of the carbon black particles.

Moreover, in accordance with a further aspect of the present invention, the fur brush 4 may be formed by a material having the resistivity of $10^4$ ohm·cm or less. In this case, the fur brush 4 is relatively electrically conductive. In this case, the fur brush 4 may be formed by such materials as carbon fibers, metal fibers and other conductive fibers. However, in the event where use is made of a dielectric film to form the image carrier member 1 and a multi-stylus recording head is used to form an electrostatic latent image on the image carrier member 1, the fur brush 4 is preferably formed by a semiconductive or insulating material because a broken conductive fiber may short-circuit the separate styluses.

Now, the operation of the magnetic cleaning device 2 shown in FIG. 1 will be described for the case when the fur brush 4 is electrically insulating. As shown in FIG. 1, as the belt 1 carrying thereon residual magnetic toner particles approaches the magnetic cleaning device 2, the imaging surface or top surface of the belt 1 comes to be scrubbed or brushed by the fur brush 4 with its bottom surface supported by the counter roller 6. As a result, the magnetic toner particles remaining on the imaging surface of the belt 1 are brushed off the belt 1. And then the magnetic toner particles thus removed from the belt 1 are attracted toward the sleeve 3 owing to the magnetic field generated by the magnets 5*a*, 5*b* and 5*f*. In addition, since the fur brush 4 is so structured to be charged in the opposite polarity to that of the imaging surface and/or the toner particles due to friction therewith, the brushed off toner particles are also electrostatically attracted to the fur brush 4.

Then the magnetic toner particles attracted to the fur brush 4 or the sleeve 3 are transported closer to the magnetic roll 7 along with the clockwise rotation of the sleeve 3. In the opposed region between the sleeve 3 and the magnetic roll 7 is formed a predetermined magnetic field due to the magnetic interaction between the magnets, mainly 5*e* and 5*f* in the illustrated example, inside the sleeve 3 and the magnetic roll 7. For this reason, the magnetic toner particles held by the fur brush 4 are transferred to the magnetic roll 7 following the magnetic force lines created between the sleeve 3 and the roll 7. Accordingly, the fur brush 4 becomes free of toner particles and thus it is made ready to be used again for cleaning the imaging surface of the belt 1. On the other hand, the magnetic toner particles thus transferred to the roll 7 are eventually scraped off by the scraper blade 8 to be collected into the toner collector 9. Preferably, an auger screw (not shown) is provided in the toner collector 9 for transporting the collected toner particles to a desired location.

In the case where the fur brush 4 is comprised of semiconductive or conductive fibers, the fur brush 4 is either difficult to be charged or hardly charged due to friction with the imaging surface of the belt 1 and/or the toner particles. Thus the toner particles brushed off the belt 1 are not significantly attracted toward the sleeve 3 electrostatically. However, in accordance with the present invention, since provision is made of magnets 5*a*–5*f* inside of the sleeve 3, these brushed off toners are magnetostatically attracted toward the sleeve 3 to be captured by the fur brush 4. Thereafter, the toner particles are transported as the sleeve 3 rotates, and they are transferred to the magnetic roll 7 from where the toner particles are collected into the collection unit 9 as scraped by the scraper blade 8.

Figure 2:
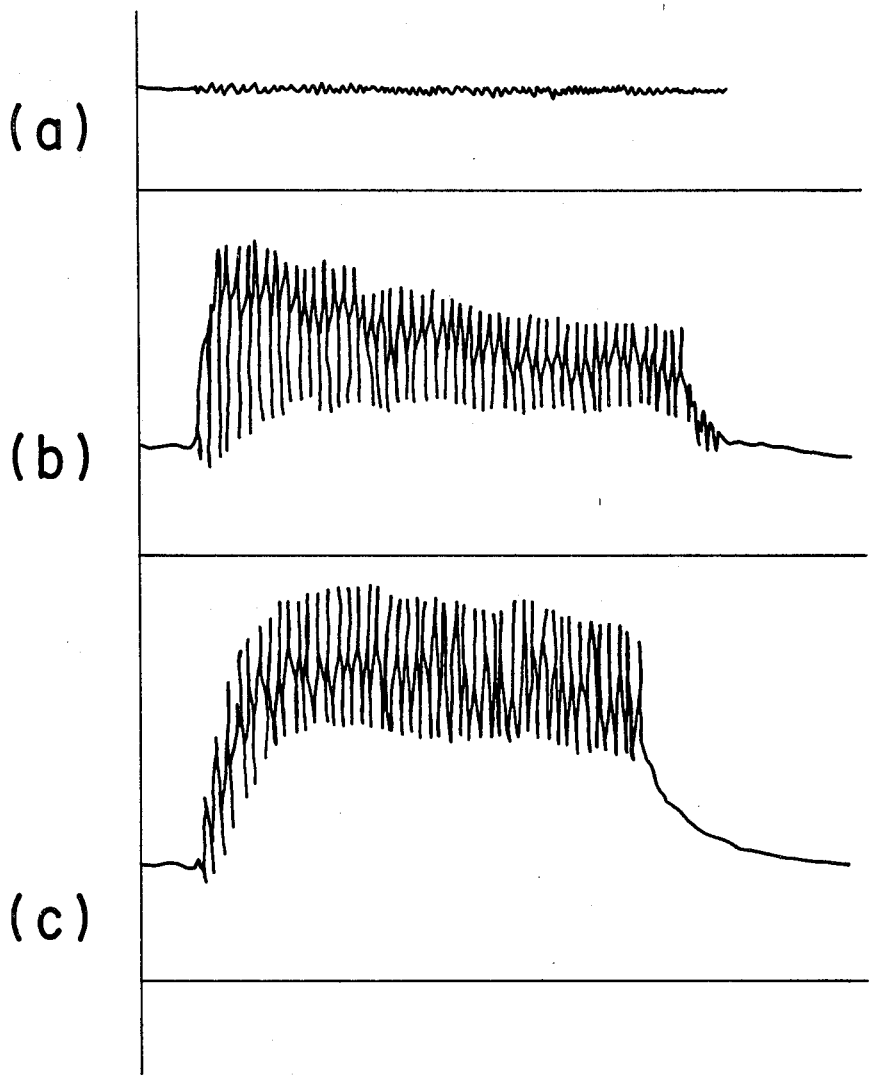
FIGS. 2 through 4 are graphs showing the measured results of frictional charging of the fur brush.
Figure 3:
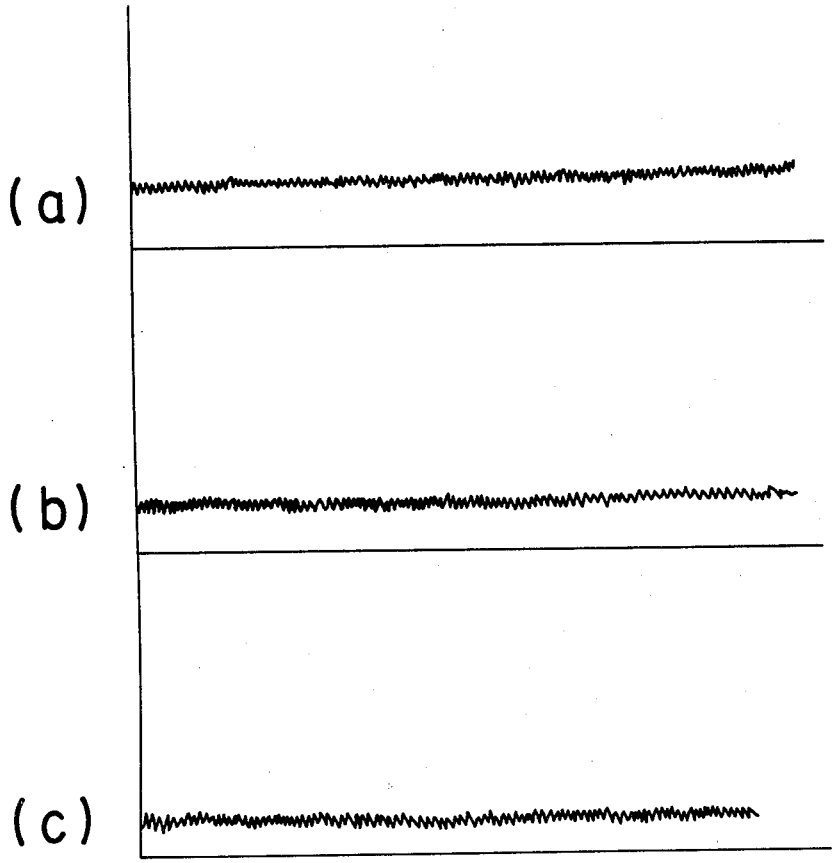
Figure 4:
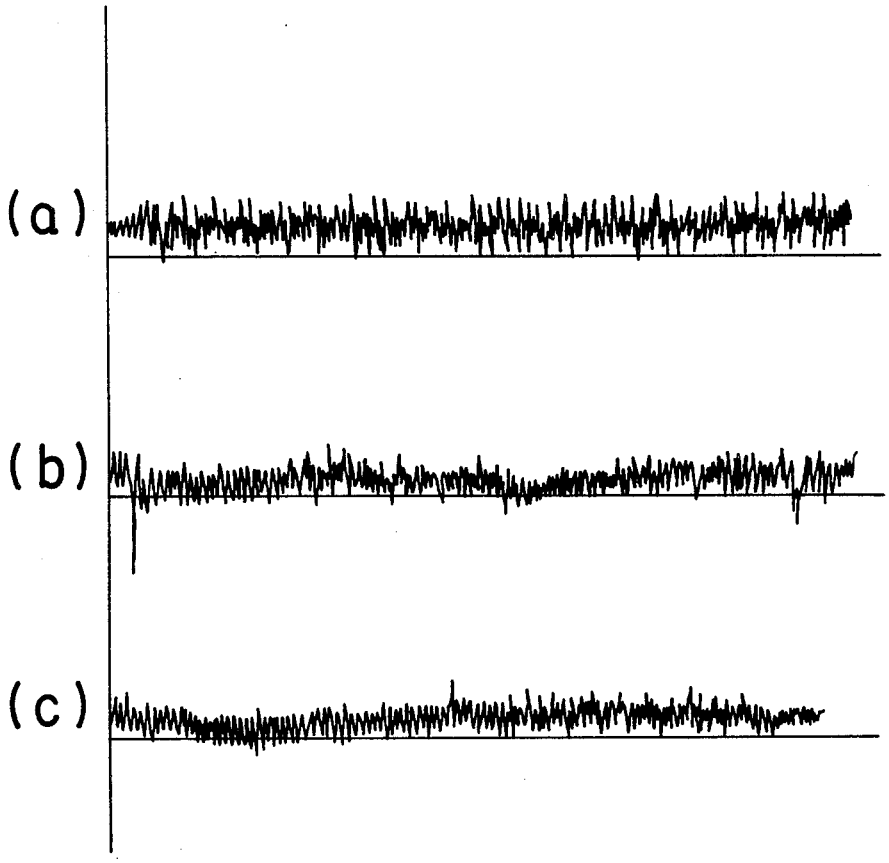

Now, the charging characteristics of the fur brush 4 due to friction against the imaging surface of the belt 1 and/or the negatively charged magnetic toner particles will be described. In this connection, FIGS. 2–4 illustrate several cases of measured results of the surface potential of the fur brush 4 when charged due to friction against the imaging surface of the belt 1 and/or the magnetic toner particles for different kinds of fur brush forming materials. That is, the measured results shown in FIG. 2 are for the case using nylon to form the fur brush 4. FIG. 3 is for semiconductive fibers and FIG. 4 is for rayon. In either of these figures, (a) indicates absence of magnetic toner particles on the imaging surface, (b) presence of first kind of magnetic toner particles on the imaging surface and (c) presence of second kind of magnetic toner particles on the imaging surface.

As shown, in the case of forming the fur brush 4 by nylon, the fur brush 4 is charged to a significantly high level in positive polarity. On the other hand, in the case where the fur brush 4 is formed by semiconductor fibers or rayon, it is clear that the fur brush 4 is difficult to be charged. As a result, if the fur brush 4 is formed by nylon, since the fur brush 4 is charged to the positive polarity which is the same polarity as the charging polarity of the toner particles, the cleaning efficiency of the toner particles from the imaging surface of the belt 1 is rather low, and it was found to range from approximately 70 to 80%. On the other hand, if the fur brush 4 is formed by semiconductive fibers or rayon, the fur brush 4 is difficult to be charged, so that the cleaning efficiency of the toner particles from the imaging surface of the belt 1 was found to be very high, ranging approximately from 90 to 95%.

As described above, when electrically insulating fibers are to be used to form the fur brush 4, the material for forming the fur brush 4 should be so selected that the fur brush 4 may be charged to the polarity opposite to that of the charged toner particles. With such a structure, the magnetic toner particles remaining on the imaging surface may be removed therefrom not only by the magnetic forces imparted by the magnets disposed inside of the sleeve 3, but also by the electrostatic forces applied by the fur brush 4. And, the thus attracted toner particles are then transferred to the magnetic roll 7 by the magnetic forces created by the cooperation between the magnets inside the sleeve 4 and the magnetic roll 7. Accordingly, in this case, an extremely high cleaning efficiency may be obtained. On the other hand, in the case where the fur brush 4 is formed by semiconductive or conductive fibers, the fur brush 4 is difficult to be charged or hardly charged, so that the brushed off toner particles do not receive any repelling electrostatic forces thereby allowing to prevent the occurrence of the disadvantage of retransferring of toner particles to the imaging surface. In this case, the removal of the magnetic toner particles from the imaging surface is carried out owing to the magnetic attractive forces applied by the magnets inside the sleeve 3, and the transfer of the toner particles from the sleeve 3 of the fur brush 4 to the magnetic roll 7 may be easily carried out in accordance with the magnetic force lines formed between the magnets inside the sleeve 3 and the magnetic roll 7 since the toner particles are not strongly attracted to the sleeve 3 or the fur brush 4 electrostatically, thereby allowing to obtain a greatly enhanced cleaning efficiency. It is also to be noted that a discharging device such as a conductive brush may be disposed in contact with or in the vicinity of the fur brush 4 to control the level of the electrostatic force to further enhance the cleaning efficiency.

Figure 5:
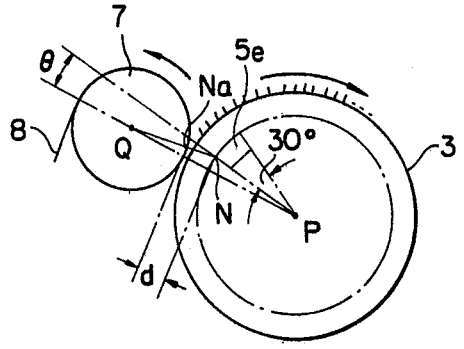
FIG. 5 is a schematic illustration showing the magnetic cleaning device constructed in accordance with another embodiment of the present invention.

FIG. 5 shows a still further embodiment of the present invention, which is directed to the particular positional relationship between the magnet 5e disposed inside of the sleeve 3 and the magnetic roll 7 so as to enhance the transfer efficiency of magnetic toner particles from the sleeve 3 to the roll 7. That is, the transfer of the magnetic toner particles riding on the sleeve 3 or its fur brush 4 to the magnetic roll 7 has been found to vary significantly depending upon the location of the magnet 5e with respect to the magnetic roll 7. The arrangement shown in FIG. 5 was used to determine such relationship. As shown, the sleeve 3 had the diameter of 36 mm and the roll had the diameter of 16.8 mm. The outermost surface of the magnet 5e with respect to the center of the sleeve 3 was 33 mm and the other magnets not shown in FIG. 5 but disposed inside of the sleeve 3 were similarly positioned. The distance between the center P of the sleeve 3 and the center Q of the roll 7 was set at 27 mm, and thus the gap between the sleeve 3 and the roll 7 was $27-(36+16.8)/2=0.6$ mm. Moreover, the magnet 5e located opposite to the roll 7 was generally in the shape of a fan and the angle formed by the side surfaces was 30 degrees.

Figure 6:
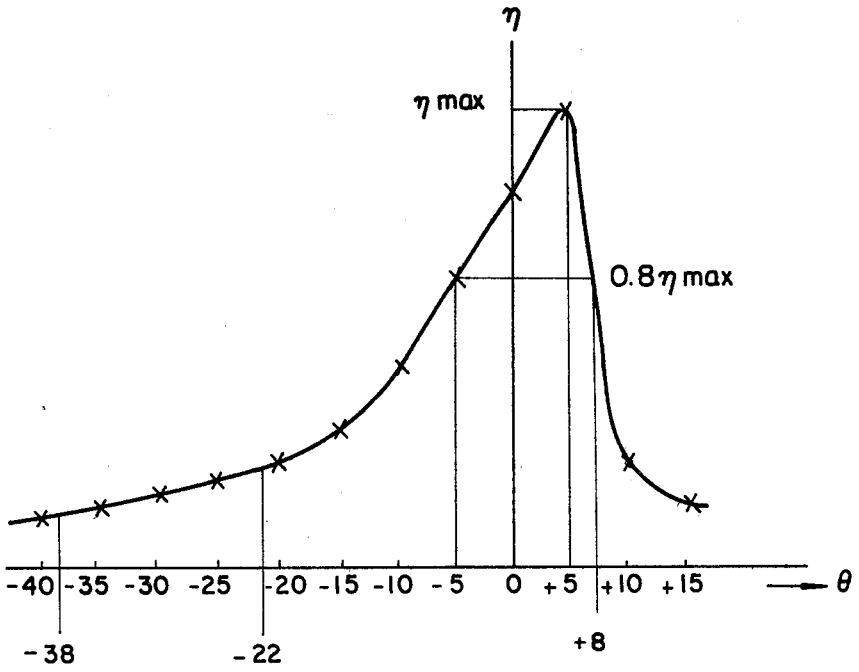
FIG. 6 is a graph showing the relation between the transfer efficiency and the angular position of the magnetic pole element 5*e* disposed inside the sleeve 3.

In FIG. 5, the leftmost edge of the outermost surface of the magnet 5e is denoted by N, and the angle NPQ formed by the line NP and the line QP is denoted by $\theta$. Under the conditions, the toner transfer efficiencies were measured by changing the angle $\theta$, and the measured results are shown graphically in FIG. 6, the abscissa and ordinate of which indicate the angle $\theta$ and the toner transfer efficiency, respectively. When the left side surface and thus the point N of the magnet 5e is located on the center to center line PQ, the angle $\theta=0$, and the angle $\theta$ is positive as the point N moves away from the line PQ in the clockwise direction; whereas, the angle $\theta$ is negative as the point N moves in the opposite direction. It is clear from FIG. 6 that excellent transfer efficiencies were obtained when the angle $\theta$ was set in the range from $-5°$ to $+8°$. When the magnet 5e is set in this angular range, the magnet 5e as a whole is located in the downstream side of the center to center line PQ with respect to the rotating direction of the sleeve 3. Under the circumstances, denoting the merging point between the straight line extending from the point N to the center Q of the roll 7 and the outer periphery of the roll 7 by Na, the distance d between the points N and Na, which is the closest distance between the magnet 5e and the roll 7, becomes 2.7 mm or less. It is true that the distance d is also 2.7 mm or less when the angle $\theta$ is set in the range between $-38°$ and $-22°$; however, in this case, since the magnet 5e as a whole becomes located in the upstream side of the center to center line PQ, the magnetic toner particles once transferred to the roll 7 are at least partly transferred back to the sleeve 3 thereby lowering the net transfer efficiency.

With the foregoing in mind, one aspect of the present invention is directed to the particular arrangement of the opposite magnet 5e with respect to the roll 7. Stated broadly, the magnet 5e should be located within a predetermined range in the downstream side of the straight line connecting the center P of the sleeve 3 and the center Q of the roll 7 with respect to the rotating direction of the sleeve 3 at the straight line. In other words, the relative positional relationship between the magnet 5e and the roll 7 should be set such that the closest distance between the magnet 5e and the roll 7 is 2.7 mm or less in a particular arrangement so as to attain excellent transfer efficiencies of the toner particles from the sleeve 3 to the roll 7. It is to be further noted that the sleeve 3 rotates clockwise and the roll 7 rotates counterclockwise, so that the directions of movement of the opposed portions of the sleeve 3 and the roll 7 are directed in the same direction when considered at the line PQ.

Figure 10:
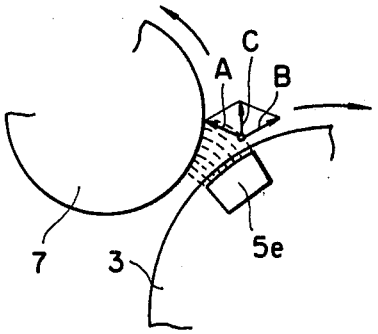
FIGS. 10 and 11 are schematic illustrations useful for explaining the particle transfer operation between the sleeve 3 and the roll 7 in the embodiments of FIGS. 5 and 7, respectively.

FIG. 10 shows the velocity vector A due to the magnetic force, the velocity vector B due to the rotation of the sleeve 3 and the resultant velocity vector C which is a combination of these two vectors. In FIG. 10, the magnetic force lines produced as the interactions between the magnet 5e and the magnetic roll 7 are indicated by the dotted lines, and, as shown, the magnetic toner particles riding on the sleeve 3 receive the strongest magnetic force when they are located at the closest point to the magnetic roll 7 and the magnetic force acting on the toner particles becomes weaker as they move further away from the roll 7. Therefore, it is advantageous to position the magnet 5e as shifted as a whole to the downstream side of the center to center line PQ with respect to the moving direction of that part of the sleeve 3 located opposite to the roll 7 because such an arrangement will contribute to prevent the back transfer of the toner particles from the roll 7 to the sleeve from taking place.

Figure 7:
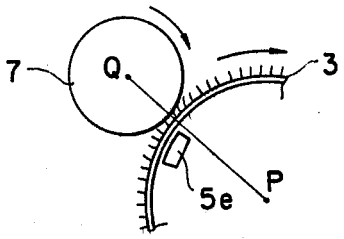
FIGS. 7 through 9 show alternative embodiments of the present invention.
Figure 11:
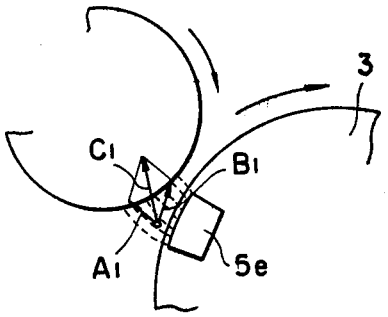

FIG. 7 shows a still further embodiment of the present device in which the magnet 5e is positioned as a whole in the upstream side of the center to center line PQ with respect to the moving direction of that part of the sleeve 3 opposite to the roll 7. It should be noted however that the roll 7 in this case is rotated in the clockwise direction, and thus both of the sleeve 3 and the roll 7 are rotated in the same direction. Put into another way, the opposed portions of the sleeve 3 and the roll 7 are directed to move in the opposite directions when considered at the line PQ. In this case also, the closest distance between the sleeve 3 and the roll is preferably set at 2.7 mm or less so as to obtain excellent transfer efficiencies as set forth above. FIG. 11 illustrates the velocity vectors of a magnetic toner particle moving in the magnetic field produced between the magnet 5e and the roll 7 as indicated by the dotted lines. As shown, the resultant velocity vector $C_1$ is pointed generally perpendicular to the peripheral surface of the roll 7, and, therefore, it is expected that enhanced transfer efficiencies may be obtained with such an arrangement.

Figure 8:
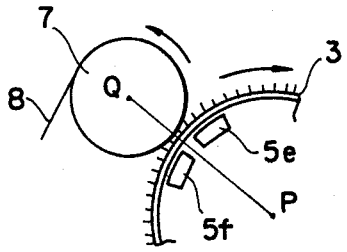
Figure 9:
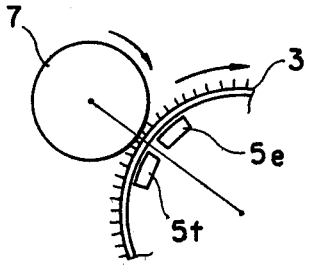

FIGS. 8 and 9 show still further embodiments of the present cleaning device, in which the two magnets 5e and 5f are positioned closer to the roll 7 as counter magnets. The magnet 5e is located as a whole as shifted to the downstream side of the center to center line PQ with respect to the moving direction of the sleeve 3 at the line PQ and the magnet 5f is located as a whole in the upstream side. It is to be noted that the only difference between FIGS. 8 and 9 resides in the direction of rotation of the magnetic roll 7. With either of these arrangements, the transfer efficiency may be still further enhanced since the toner particles are subjected to the transfer magnetic fields twice so to speak.

In any of the embodiments described above, it is also true that the toner transfer efficiency may be still further enhanced by setting the peripheral speed of the magnetic roll 7 larger than that of the sleeve 3.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A magnetic cleaning device for cleaning magnetic particles from the surface to be cleaned, comprising:

first carrier means supported to move along a first predetermined path a part of which is located closer to said surface where said magnetic particles may be removed by said first carrier means;

attracting means for causing said magnetic particles to be attracted to said first carrier means;

second carrier means supported to move along a second predetermined path a part of which is located closer to said first carrier means where said magnetic particles carried on said first carrier means may be transferred to said second carrier means; and collection means for collecting said magnetic particles transferred to said second carrier means.

2. A device of claim 1 wherein said first carrier means includes a sleeve supported to be driven to rotate in a first predetermined direction and a fur brush fixedly provided on the outer peripheral surface of said sleeve.

3. A device of claim 2 wherein said sleeve is formed by a nonmagnetic material and said fur brush is formed by a plurality of fibers partly planted in the outer peripheral surface of said sleeve whereby said sleeve is so disposed that said fibers planted in said sleeve are partly in brushing contact with said surface to be cleaned.

4. A device of claim 3 wherein said fibers are comprised of a relatively insulating material having the resistivity of $10^8$ ohm-cm or more and said material has the property of either being charged to the polarity opposite to that of said particles due to friction therewith or being difficult to be charged due to friction with said particles and/or said surface to be cleaned.

5. A device of claim 4 wherein in the case where said magnetic particles are charged in the positive polarity, said relatively insulating material is selected from the group essentially consisting of Teflon, polypropylene, polyethylene, vinyl chloride, Tetron, rayon and polyester.

6. A device of claim 4 wherein in the case where said magnetic particles are charged in the negative polarity, said relatively insulating material is selected from the group essentially consisting of nylon and similar other materials.

7. A device of claim 3 wherein said fibers are comprised of a relatively semiconductive material having the resistivity ranging from $10^4$ to $10^8$ ohm-cm.

8. A device of claim 7 wherein said relatively semiconductive material is a mixture of an acrylic polymer and fine carbon black particles dispersed in said polymer.

9. A device of claim 3 wherein said fibers are comprised of a relatively conductive material having the resistivity of $10^4$ ohm-cm or less such as carbon and metals.

10. A device of claim 3 wherein said attracting means includes a plurality of magnets disposed inside of and along the inner peripheral surface of said sleeve so as to keep said magnetic particles attracted to the outer peripheral surface of said sleeve.

11. A device of claim 10 wherein said second carrier means includes a roll made of a magnetic material, said magnetic roll being supported to be driven to rotate in a second predetermined direction and disposed in parallel with and adjacent to said sleeve so that said magnetic particles transported as attracted to the outer peripheral surface of said sleeve may be transferred to said magnetic roll.

12. A device of claim 11 wherein said collection means includes a scraper blade having its one edge set in scraping contact with the peripheral surface of said magnetic roll so that the magnetic particles transferred to said roll may be sraped off said roll and collected by said collection means.

13. A device of claim 11 wherein one of said magnets is disposed opposite to said magnetic roll as a counter magnet to mainly form the transfer magnetic field between said sleeve and said roll thereby transferring the magnetic particles from said sleeve to said roll, and in the case where said first predetermined direction is the clockwise direction and said second predetermined direction is the counter-clockwise direction, said counter magnet is so disposed as to be located in the downstream side as a whole of the line connecting between the centers of said sleeve and said roll with respect to the direction of movement of that portion of said sleeve intersecting said line.

14. A device of claim 13 wherein the closest distance between said counter magnet and said roll is 2.7 mm or less.

15. A device of claim 11 wherein one of said magnets is disposed opposite to said magnetic roll as a counter magnet to mainly form the transfer magnetic field between said sleeve and said roll thereby transferring the magnetic particles from said sleeve to said roll, and in the case where said first predetermined direction is the clockwise direction and said second predetermined direction is also the clockwise direction, said counter magnet is so disposed as to be located in the upstream side as a whole of the line connecting between the centers of said sleeve and said roll with respect to the direction of movement of that portion of said sleeve intersecting said line.

16. A device of claim 15 wherein the closest distance between said counter magnet and said roll is 2.7 mm or less.

17. A device of claim 11 wherein two of said magnets are disposed opposite to said magnetic roll as counter magnets to mainly form the transfer magnetic field between said sleeve and said roll thereby transferring the magnetic particles from said sleeve to said roll, and said two counter magnets are disposed on the opposite sides of the line connecting between the centers of said sleeve and said roll.

18. A device of claim 17 wherein said sleeve and said roll are driven to rotate in the same direction.

19. A device of claim 17 wherein said sleeve and said roll are driven to rotate in the opposite directions.

20. A device of claim 11 wherein the peripheral speed of said roll is faster that the peripheral speed of said sleeve.

21. A device of claim 11 wherein said surface to be cleaned is an imaging surface and said magnetic particles are magnetic toner particles which are to be used to develop an electrostatic latent image formed on said imaging surface to convert it into a visual toner image, and said magnetic cleaning device is to be used for cleaning the residual magnetic toner particles remaining on said imaging surface after transfer of said toner image to a transfer medium.

22. A device of claim 21 wherein said imaging surface is defined by a surface of an image carrier member, and said device further includes a counter roller disposed below and spaced apart over a predetermined distance from said sleeve for guiding the advancement of said image carrier member thereby allowing to keep a desired brushing contact between said fur brush and said imaging surface.

23. A magnetic cleaning device for cleaning magnetic toner particles from the imaging surface which is repetitively presented for use, comprising:

a sleeve supported to be driven to rotate in a predetermined direction, said sleeve having fur brush fixedly provided on its outer peripheral surface such as to be partly in brushing contact with said imaging surface, said fur brush being comprised of a material which is charged due to friction with said imaging surface and magnetic toner particles to the polarity opposite to that of said magnetic toner particles;

magnetic field producing means disposed inside of said sleeve for producing a magnetic field at least around said sleeve so as to cause said magnetic toner particles attracted toward said sleeve; and removing means for removing said magnetic toner particles from said sleeve.

24. A magnetic cleaning device for cleaning magnetic toner particles from the imaging surface after image transfer, said imaging surface being repetitively used for forming a magnetic toner image and then transferring the thus formed toner image to a transfer medium, said device comprising:

a sleeve supported to be driven to rotate in a first predetermined direction, said sleeve having fur brush as fixedly provided on its outer peripheral surface so as to be partly in brushing contact with said imaging surface;

a magnetic roll disposed in parallel with and adjacent to said sleeve, said magnetic roll being driven to rotate in a second predetermined direction thereby causing the magnetic toner particles transferred from said sleeve to said roll;

scraping means for scraping the magnetic toner particles off said roll to be collected in a collection unit; and a plurality of magnetic pole means disposed inside of said sleeve, one of said magnetic pole means being disposed in the downstream side of and separated away over a predetermined distance from the stright line connecting between the centers of said sleeve and roll with respect to the rotating direction of said sleeve.

* * * * *